United States Patent [19]

Zimmer

[11] Patent Number: 4,998,500

[45] Date of Patent: Mar. 12, 1991

[54] SQUEEGEE DEVICE

[76] Inventor: Johannes Zimmer, Ebentaler Strasse 133, 9020 Klagenfurt, Austria

[21] Appl. No.: 364,436

[22] Filed: Jul. 13, 1989

[30] Foreign Application Priority Data

| | | | |
|---|---|---|---|
| Oct. 10, 1987 | [EP] | European Pat. Off. | 87730126.7 |
| Oct. 10, 1987 | [EP] | European Pat. Off. | 87730128.3 |
| Oct. 10, 1987 | [DE] | Fed. Rep. of Germany | 3734747 |
| Oct. 10, 1987 | [DE] | Fed. Rep. of Germany | 8713789 |
| Oct. 10, 1987 | [DE] | Fed. Rep. of Germany | 8713788 |

[51] Int. Cl.[5] ..... B05C 11/02

[52] U.S. Cl. ..... 118/110; 118/119

[58] Field of Search ..... 427/354, 369; 118/264, 118/200, 623, 100, 119, 110, 112; 15/121

[56] References Cited

U.S. PATENT DOCUMENTS

| | | | |
|---|---|---|---|
| 2,774,329 | 12/1956 | Smith | 118/104 |
| 3,701,335 | 10/1972 | Barnscheidt | 118/119 |
| 4,245,582 | 1/1981 | Alheid et al. | 118/119 |
| 4,367,691 | 1/1983 | Bergs | 118/119 |
| 4,508,050 | 4/1985 | Tittman | 118/119 |
| 4,518,637 | 5/1985 | Takeda et al. | 118/119 |
| 4,521,459 | 6/1985 | Takeda | 118/119 |

FOREIGN PATENT DOCUMENTS

| | | |
|---|---|---|
| 1135856 | 9/1962 | Fed. Rep. of Germany . |
| 2544784 | 4/1976 | Fed. Rep. of Germany . |
| 2544784 | 4/1976 | Fed. Rep. of Germany . |
| 3419590 | 11/1984 | Fed. Rep. of Germany . |

*Primary Examiner*—Willard E. Hoag

*Attorney, Agent, or Firm*—Fay, Sharpe, Beall, Fagan, Minnich & McKee

[57] ABSTRACT

A squeegee device applies material to a web substrate, which is guided across or held in contact with an abutment. The support body of the sequeegee contains a magnetic device extending along its longitudinal direction that holds a squeegee element made of magnetizable material. The squeegee edge is held against the substrate by the force of a magnetic device in the support body of the squeegee and a magnetic device under the abutment. In an alternative embodiment, no magnetic device is located under the abutment. However the abutment is made of ferrous metal to attract the magnetic device, causing pressure between the substrate and squeegee.

22 Claims, 1 Drawing Sheet

Fig. 1
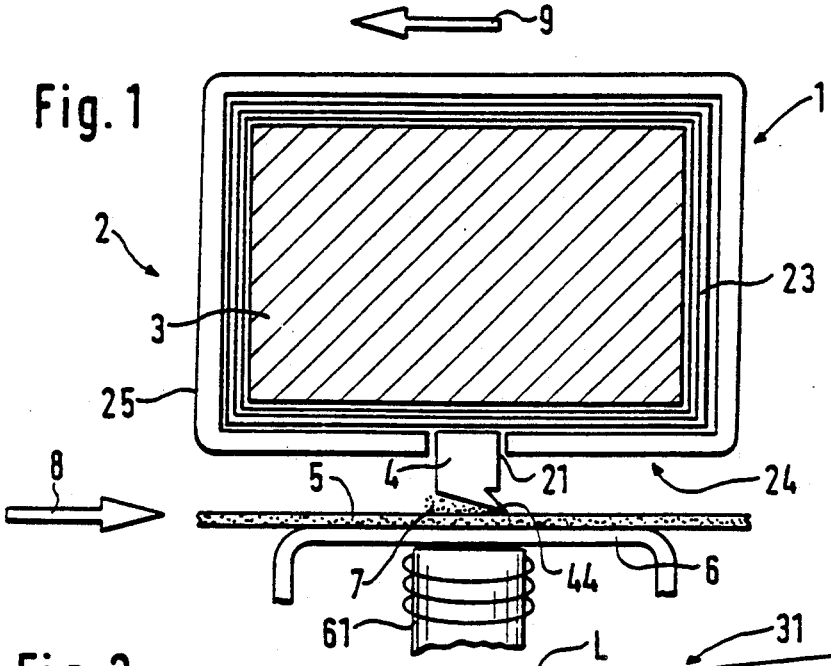
Fig. 2
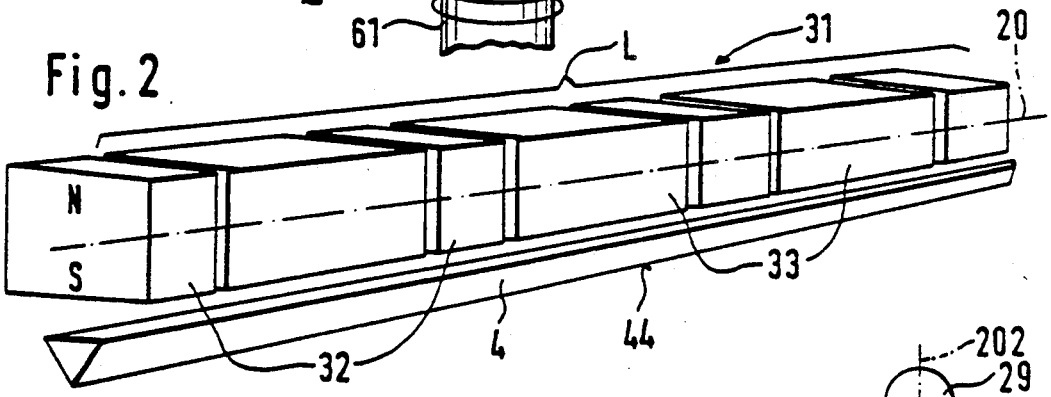
Fig. 3
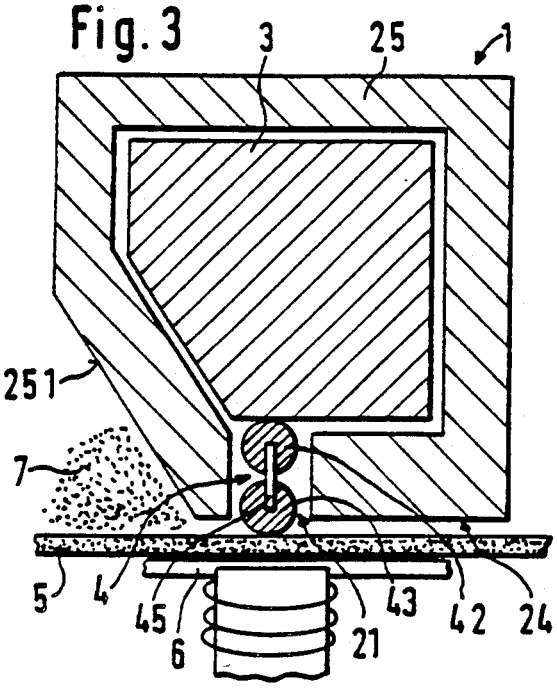
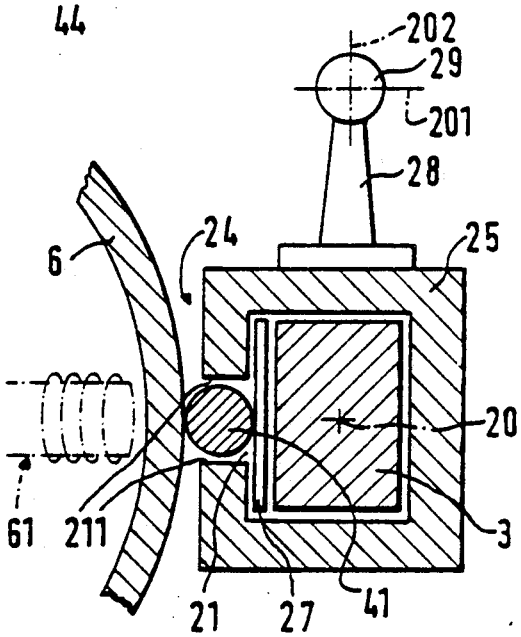
Fig. 4

SQUEEGEE DEVICE

FIELD OF THE INVENTION

The invention relates to a squeegee device for applying application material, such as optionally foamable substances of different viscosity, coating substances, varnishes, adhesives, pastes, etc. to a substrate, such as a web. Such a squeegee device is used in machines for flat stencil printing, round stencil applications and/or means for stencil-free, full-surface applications, in which the application width of a squeegee is several meters. As a function of the machine type, it is possible to carry out patterning applications (printing) and/or full-surface applications (e.g. impregnating, coating, dyeing and varnishing).

BACKGROUND OF THE INVENTION

With regard to the operating and use possibilities of an applying device and with respect to the substance application result, decisive importance is attached to the squeegee used and/or the squeegee device comprising the same. Squeegee devices are known (DE-AS No. 1 135 856), in which a magnetizable squeegee can be magnetically pressed in the direction of a magnetic beam extending along the squeegee and arranged below the substrate path. It is also known to provide on the back of a sheet spreading doctor a magnetizable strip fixed to the doctor over the application width, so that by means of the strip, the doctor can be pressed against a substrate by the magnetic force of a magnetic beam (DE-OS No. 34 19 590). In a further squeegee device, (DE-OS No. 25 44 784) a squeegee roller can be magnetically pressed onto the back of a separately arranged profile strip spaced from the rolling surface of the roller. In addition, devices with mechanically pressable squeegees are known, the squeegee being laterally fixed and pressed towards the substrate. In the magnetic pressing device, the magnetizable mass of the squeegee or a support member connected non-detachably and in one piece thereto must correspond to the size of the desired magnetic pressing force. This leads to squeegees having undesired distortion forces, limiting their work and profile.

The usability of known squeegee devices is also unsatisfactory, because they must be designed and used only for specific applications. A squeegee which can be pressed onto a separately arranged profile strip must be specially adapted to the strip and must be handled in the form of several individual components. In each case, within the known devices, the squeegee must be sufficiently solid for the relatively large pressing forces and therefore be designed as a function of the contact pressure. Such solid squeegees are less suitable in applications where the width of the squeegee is greater than a few meters due to their inherent rigidity and the resulting undesired curvature. They require relatively large magnetic or mechanical pressing forces leading to a correspondingly high energy expenditure. Mounting supports of the known squeegee devices frequently lead to disadvantageous tilting effects with regard to the squeegees. Relatively thin and long squeegees, such as sheet coating doctors, roller doctors or round doctor strips are very sensitive and can in particular be damaged by bending, so that their individual handling is very critical.

OBJECT OF THE INVENTION

In view thereof, it is the object of the present invention to provide a particularly simple, compact and universally usable squeegee device, which can be handled easily and used as a handling unit with a desired coating profile, the coating profiles being protected against damage and being suited to be arranged in tilt-free manner and used independently of the contact pressure.

SUMMARY OF THE INVENTION

In conjunction with the initially mentioned features of the squeegee device according to the invention, the object is achieved by constructing a squeegee device as a tubular, rod-shaped or strip-shaped support body containing a magnetic device along its longitudinal direction which holds a squeegee element made of magnetizable material and extends in the longitudinal direction of the support body. The squeegee element is held in place by the magnetic force of the magnetic device. Thus, the invention allows relatively small cross-section profile squeegees having flectional elasticity to be arranged in a replaceable, tilt-free manner on the support body.

The support body and each squeegee integrated therein forms a unitary, one-piece, quasi-integral squeegee unit component which is relatively compact and allows the squeegee to be easily handled without any damage. The support body and the squeegee can be jointly fitted into or removed from a printing device, particularly in the relatively confined space within a round stencil; they can also be cleaned as a unit. The squeegee device is particularly advantageous for the handling of long, small diameter rod profile squeegees because the squeegee is held on the support body without any risk of bending and is handled together therewith. The support body containing the magnetic device is used to effect the pressing of the complete squeegee unit. Although it is possible in principle to mechanically press the magnetic support body, it is an important feature of the invention that the magnetic device holding the squeegee can be used for magnetically pressing the unit towards a substrate web. Thus, the magnetic device can be attracted by a magnetic beam or bar extending in the application width below a substrate web. It is also possible to equip the magnetic device with such strong magnets so that the squeegee device unit can be pressed against a magnetizable opposite body, such as a steel surface, e.g. in the form of a printing table or a substrate guide roller. The squeegee device according to the invention is universally usable for numerous purposes, such as applications with or without a stencil and/or applications to substrate webs moving under a random angle.

According to an embodiment of the invention, the support body contains an envelope of magnetizable or magnetically neutral material completely surrounding the circumference of the magnetic device. If a magnetizable envelope is used, it will provide an additional pressing force of the squeegee device against a magnetic beam. The magnetic device can be embedded in a casing of the support body either alone or in addition to the envelope. The squeegee side of the casing contains a slit or gap in the longitudinal direction of the support body. The slit or gap appropriately forms a recess which contains the squeegee held therein by the magnetic device. This configuration allows for rapid and easy use and replaceability of the squeegee.

According to a particular construction, the outer wall of the casing has a profile surface facing the area where the substance is to be applied. This area is located directly upstream of the squeegee, in order to bring about a dosing of the substance to be applied and/or a prior squeegee treatment.

It is particularly appropriate to arrange the envelope and the casing so as to be displaceable relative to one another in the longitudinal direction of the support body. Thus it is possible to bring the magnetic device with its poles into a desired position with respect to the poles of a magnetic beam. Such adjustments can be particularly advantageously realized when the magnetic device is arranged in displaceable manner in the longitudinal direction of the support body in the envelope and/or casing.

In order to obtain a squeegee device having maximum flectional elasticity and substantially avoiding inherent rigidity over a relatively large application width (longitudinal direction of the device), at least the envelope against which the squeegee is attracted is made from a flectional elastic material.

In place of an envelope and/or casing, the support body can also comprise a strip which extends in the longitudinal direction of the body, on which is a magnetic device. It is also possible that the support body solely comprises a magnetic device on which the squeegee is held by magnetic force.

A particular embodiment of the squeegee device has the squeegee element in the form of a roll doctor held in freely rotatable manner in the recess. A sliding layer or coating is arranged between the magnetic device and the roll doctor in order to assist the movement of the latter.

It is advantageous in certain applications for the walls of the receptacle to be formed with a large spacing clearance so that the roll doctor is mounted with a relatively large backlash in the receptacle transversely to the extension of the roll doctor. As a function of the operating positioning of the roll doctor in the receptacle, it is rotatably guided against one of the walls and/or the sliding layer. Such abutments permit a sealing or insulation against the substance to be applied, so that it cannot pass into the space located downstream in the applying direction of the doctor. It is particularly stressed that a roll doctor arranged in a squeegee device, whose doctor side is a at smaller, but fixed distance with respect to a counterabutment, can be torn away from the sliding layer of the magnetic device by the magnetic force of a magnetic beam from the abutment during doctor operation. This allows the doctor to rotate particularly easily in the receptacle. On demagnetizing the magnetic beam, the roll doctor jumps into its reception position on the support body and can be handled together with the latter.

According to another embodiment of the invention, the squeegee element can be constructed together with at least one rod made of magnetizable material which extends in the longitudinal direction of the support on the magnetic device. The rod is arranged between a squeegee and the magnetic device. In order to form a pressing part, such a rod is appropriately pressable in the direction of an abutment producing a magnetic force.

According to another embodiment of the invention, the magnetic device comprises a permanent magnet arrangement positioned along the longitudinal axis of the support body. It is in a particularly simple manner constructed with permanent magnets juxtaposed in the direction of the longitudinal axis of the body. A particularly favourable spatial arrangement of the permanent magnets is achieved by placing spacers, preferably having the same length, made from magnetizable or non-magnetizable material between adjacent magnets. In order to make the magnetic device handlable as a unit, but elastic over the application width, the permanent magnets are firmly connected to each adjacent spacer, e.g. by adhesion or bonding, and the spacers are made from flectional elastic material.

In order to assist the support body the pressing the squeegee element through the use of gravity, at least some parts of the support are made from a material with a high density.

The squeegee device support body can be held with various mounting supports in an applicator or printing press, particularly so as to be movable towards the substrate web. It is particularly appropriate for the support body to be pivotable by a mechanical and/or material-elastic joint arranged thereon. By using a spherical bearing arranged on the support body central to the length of the squeegee device, it is possible to obtain, in advantageous manner, a pivotability of the squeegee device in all directions in space. This permits the working edge of a squeegee element to be applied or pressed in freely adaptable manner to the substrate web such as a stencil.

Further advantages, developments and embodiments of the invention are described hereinafter relative to the drawings.

BRIEF DESCRIPTION OF THE DRAWINGS

FIG. 1 is a cross-section is a squeegee device according to the invention with a multipart support body.

FIG. 2 is an exploded view of a permanent magnet and a squeegee element of a squeegee device according to the invention.

FIG. 3 is a detailed cross-section of a squeegee device having two interconnected circular rods which form the squeegee element.

FIG. 4 is a detailed cross-section of an alternate embodiment of a squeegee device having the squeegee casing pivotally mounted.

DETAILED DESCRIPTION OF THE PREFERRED EMBODIMENTS

The squeegee devices 1, shown in the drawings, form part of a not shown applying device or printing press and are held in mounting supports (not shown). Each squeegee device 1 is provided with a working or doctor edge 44 of a squeegee element 4 arranged on the squeegee device for acting on a substrate 5, such as a substrate web, over the length L (application width) of the squeegee device. Relative movement between working edge 44 of squeegee element 4 and substrate 5 applies a substance 7 to the substrate 5, optionally through a not shown patterning stencil. The substrate 5 is guided or held on an abutment 6.

A magnetic beam or bar 61 can be arranged on the abutment 6 to over the application width and magnetically engage a magnetic device 3 and/or magnetizable parts 23 of the squeegee device 1, including the magnetizable squeegee element 4. Examples of this type of embodiment of the squeegee device 1 are shown in FIG. 3 and in the case of the arrangement of a magnetic beam 61, in FIG. 4. It can be particularly advantageous that only the magnetic device 3 of a squeegee device 1 produces the magnetic force to work against a magnetizable abutment 6, such as a steel table or roller. In such a case, the applying device contains the support magnetic device 3 as the sole magnetic force source. Device 3 magnetically engages the abutment and brings about a relative pressing thereof against the squeegee element 4 without the employment of any other magnetic device such as magnetic beam 61. Such an application is shown in FIG. 4 for an applying device with a vertically guided substrate web.

FIG. 1 shows a squeegee device 1 containing a magnetic device 3, which is embedded in a relatively thin envelope 23 of elastic material surrounding the same. The envelope 23 forms an inner casing which is surrounded by an outer casing 25. The outer casing has a slit which forms recess 21 on the squeegee side 24 of the device.

A squeegee element 4, made of a magnetizable material, is placed in the slit and is magnetically attracted by the magnetic device 3, so that it is held under magnetic force against the inner casing 23, which can also comprise magnetizable material.

The squeegee element 4 is constructed as a spreading doctor with a wedge-shaped working edge 44. For the application of a substance 7 to a web 5, the squeegee 4 is magnetically pressed against the web 5 through the reciprocal attraction of the magnetic force of an electromagnetic beam 61 and the magnetic force of the magnetic device 3. The squeegee device 1 is moved in the direction of arrow 9 during the application process and/or the substrate web 5 is guided in direction 8 in the case of an optionally fixed squeegee device 1.

FIG. 2 shows the construction of a magnetic device 3 in the longitudinal direction L of the squeegee device. It comprises several series-juxtaposed permanent magnets 32 over the application width L and a magnetic material spacer is provided between the adjacent permanent magnets.

The material can be magnetizable or magnetically neutral. Alternatively, the permanent magnet segments 32 can be electromagnets instead of permanent magnets.

FIG. 2 shows a magnetizable squeegee element 4 in the form of a thin, flectional elastic rod with a triangular cross-section. The squeegee elements has one longitudinal surface magnetically engaged on the magnetic device 3. A doctor edge 44 is formed by one edge of the triangular profile.

A squeegee device 1 in FIG. 3 contains a magnetic device 3, which is embedded in a casing 25. The casing has on the squeegee side 24, a slit-like recess 21 extending over the application width. The slit contains a squeegee element 4, which contains two cross-sectionally circular rods 42, 43, which are interconnected over the application width and/or at their terminal ends with a web or plug-in member 45.

The rod strip 43 forms a round doctor for the application of a substance 7 to a substrate web 5. The round rod strip 42 is positioned between the magnetic device 3 and the doctor 43. It is made of a magnetizable material and is pulled by the magnetic force of a magnetic beam 61 and consequently exerts a magnetic pressing action on the doctor 43 in the direction of the substrate web 5. The rod 42 is held magnetically on the magnetic device 3. The doctor 43, like rod strip 42, can also be made from magnetizable material or it can also be made from non-magnetic material, such as plastic, glass or a ceramic material.

A profile surface 251 is formed on the casing 25 and extends over the application width, forming a wedge-shaped space for the application substance 7 under an angle with the substrate web 5. Thus, the application quantity is dosed in a simple manner and/or a prior or preliminary squeegee treatment is obtained.

FIG. 4 shows a squeegee device 1 constructed with a magnetic device 3 embedded in a casing 25, and has a slit-like recess 21 on the squeegee side 24. A squeegee element held therein by the magnetic force of the magnetic device 3 is constructed as a magnetizable roll doctor rod 41. During the operation of the squeegee device 1, the roll doctor 41 rotates about its longitudinal axis in the recess 21. It rolls on a sliding layer 27, which extends over the entire application width between the magnetic device 3 and the doctor 41. The roll doctor 41 is rotatably mounted between the walls 211 and is arranged with a clear spacing of recess 21. The squeegee device 1 with the roll doctor 41 is intended to work against a substrate web guided vertically on a roller abutment 6. The squeegee device 1 is held in an applying device in a pendulous or pivotable manner by a joint member 28. At least one tilting movement about an axis parallel to the longitudinal axis 20 of the squeegee device can be performed with respect to the fixed roller body 6. The articulation of the squeegee device 1 can also be designed for pivoting movements about axes 201 and 202, where 202 is perpendicular to the longitudinal axis 20. In addition, pivotability about all directions in space can be achieved by a spherical joint 29 arranged on the arm member 28. A universal pivoting articulatability of a squeegee device 1 generally ensures a very simple mounting and tilt-free orientability of the squeegee device on an abutment 6.

I claim:

1. An apparatus for applying application material to a substrate comprising:

an abutment for supporting said substrate;

a squeegee device having a support body, magnetic means inside said support body, and a squeegee element made of a magnetizable material held onto the said support body by said magnetic means; and said abutment being of a magnetically attractable material so that an attractive magnetic force is generated between said abutment and said squeegee device to press said squeegee element against said substrate.

2. An apparatus according to claim 1, wherein said support body comprises an envelope that completely surrounds said magnetic means .

3. An apparatus according to claim 1, wherein a profile surface for at least one of substance dosing or prior squeegee treatment is formed on said casing.

4. An apparatus according to claim 1, wherein said envelope and said casing are relatively displaceable to each other in a longitudinal direction of the support body.

5. An apparatus according to claim 1, wherein said magnetic means is arranged displaceably in a longitudinal direction of said support body in said envelope casing.

6. An apparatus according to claim 1, wherein said support body comprises a strip on which is arranged said magnetic means.

7. An apparatus according to claim 1, wherein said squeegee element comprises a profile rod squeegee having a round, rectangular or wedge-shaped cross-section.

8. An apparatus according to claim 1, wherein at least one magnetizable material rod, extending in the longitudinal direction of said support body, is provided between said magnetic means and said squeegee element.

9. An apparatus according to claim 1, wherein said support body is mounted for pivotable movement by a joint member arranged thereon.

10. An apparatus according to claim 1, wherein said abutment includes another magnetic means for causing said attractive magnetic force between said abutment and said squeegee device to be a reciprocal magnetic attractive force.

11. An apparatus according to claim 1, wherein said support body has a casing surrounding said magnetic means, and said casing has a recess extending in the longitudinal direction of said support body for receiving said squeegee element therein.

12. An apparatus according to claim 11, wherein at least one of said envelope and said casing is made from elastic material.

13. An apparatus according to claim 1, wherein said magnetic means comprises a permanent magnet arrangement arranged along the longitudinal axis of said support body.

14. An apparatus according to claim 13, wherein said permanent magnet arrangement comprises at least two permanent magnets arranged in series.

15. An apparatus according to claim 14, wherein a spacer is placed between each of said permanent magnets.

16. An apparatus according to claim 15, wherein each of said permanent magnets is fixed to each adjacent spacer, and the spacers are made from flectional elastic material.

17. An apparatus according to claim 1, further comprising said support body having a recess in the longitudinal direction of said support body for receiving said squeegee element within said recess.

18. An apparatus according to claim 17, wherein said recess has walls for movably supporting a roll doctor in said recess transversely to its extension.

19. An apparatus according to claim 17, wherein said squeegee element is held in a freely rotatable manner as a roll doctor in said recess.

20. An apparatus according to claim 19, further comprising a sliding layer or coating positioned between said magnetic means and said roll doctor.

21. An apparatus according to claim 19, wherein said abutment includes another magnetic means which can be engaged to provide another magnetic attractive force, or disengaged to provide no magnetic force, wherein when said another magnetic force of said abutment is engaged, said roll doctor is pulled from said magnetic means of said support body and protrudes, at least partially, out of said recess, and upon disengagement of said another magnetic means of said abutment, said roll doctor returns into said recess.

22. An apparatus according to claim 21, further comprising a sliding layer between and in contact with said roll doctor and said magnetic means of said support body, wherein when said another magnetic means of said abutment is engaged, said roll doctor is pulled off of and out of contact with said sliding layer to protrude at least partially out of said recess.

* * * * *